US006019705A

United States Patent [19]

Thom et al.

[11] Patent Number: 6,019,705

[45] Date of Patent: Feb. 1, 2000

[54] DEVICE FOR ASSISTING IN CREEPING EXERCISES

[75] Inventors: Paul Thom, Montclair; Kurt Landsberger, Verona, both of N.J.

[73] Assignee: Bel-Art Products Inc., Pequannock, N.Y.

[21] Appl. No.: 09/048,479

[22] Filed: Mar. 26, 1998

[51] Int. Cl.[7] ..... A63B 22/00

[52] U.S. Cl. ..... 482/51; 482/56; 482/52

[58] Field of Search ..... 297/423.11, 5, 297/6; 482/51, 52, 66

[56] References Cited

U.S. PATENT DOCUMENTS

| | | | |
|---|---|---|---|
| 3,532,356 | 10/1970 | Lillibridgte . | |
| 3,992,023 | 11/1976 | Moorer . | |
| 4,796,903 | 1/1989 | Proctor et al. | 482/51 |
| 4,890,853 | 1/1990 | Olson | 482/51 |
| 5,046,750 | 9/1991 | Heubl . | |
| 5,407,406 | 4/1995 | Canela | 482/51 |
| 5,590,892 | 1/1997 | Hu . | |
| 5,716,101 | 2/1998 | Frinier et al. | 297/440.11 |

OTHER PUBLICATIONS

Ableware Catalog (1 page, Item H70412–0000) Flaghouse Catalog (p.36).

*Primary Examiner*—Jerome W. Donnelly
*Attorney, Agent, or Firm*—Lawrence G. Fridman

[57] ABSTRACT

A device for assisting in the performance of creeping exercise includes an exercise support frame having at least first and second side supports spaced from each other; a flexible support arrangement for supporting a user within the support frame during the exercise and a coupling arrangement for adjustably coupling the flexible support means to the support frame. Upon placement of the user within the flexible support arrangement, one portion of the flexible support arrangement engaging one of the side supports presses against another portion of the flexible support arrangement and presses against the frame, so that the flexible support arrangement is locked in a predetermined position supporting the user.

16 Claims, 11 Drawing Sheets

DEVICE FOR ASSISTING IN CREEPING EXERCISES

FIELD OF THE INVENTION

This invention relates generally to devices used to assist mentally or physically handicapped persons in the performance of mobility exercises or activities, and specifically relates to devices used to assist in the performance of creeping exercises and activities.

BACKGROUND OF THE INVENTION

Mechanical devices are often used in physical therapy applications to assist medically or physically handicapped persons in the performance of certain activities which they would otherwise be unable to perform. In some instances, mechanical devices are used to overcome developmental shortcomings. For example, it is understood that the nervous system of each human being must go through a definite series of developmental stages before a brain can operate at its full potential. Substantial negative consequences may result from a child skipping a phase in this developmental sequence because of brain injury or lack of opportunity. For example, many of the "slow" children never had an opportunity to learn to crawl or creep well.

The treatment for such disability includes a pattern of exercises consisting of creeping and crawling and which is designed to stimulate and build up a child's neurological organization. Such treatment involves the step by step development of the central nervous system. The distinction between crawling and creeping for purposes of treatment is that in crawling, the child moves forward by pulling with the arms and pushing with the legs, both at the same time with a stomach on the floor, whereas in creeping the stomach is off the floor and the child advances by reaching with one arm and pushing with the opposite leg, and then repeating this pattern with the other arm and leg. Although important, it is often difficult to motivate the child to advance from a crawling phase to the creeping phase, that is to lift the stomach off the ground, so that it is supported by his arms and legs. Therefore, prior art devices have been used to assist children in performing creeping action by supporting a body in a creeping position.

Other studies have been conducted to determine why independent walking is delayed for blind babies. These studies have indicated that in the natural stages of development, creeping must precede walking and that blind children exhibit a marked lag in the achievement of creeping. It was found that in sighted children, the early creeping pattern results from attempts by the child to reach for out-of-range objects. Thus, early creeping is a reach and a collapse sequence which gradually smoothes out and becomes a motor pattern of creeping. However, for the blind baby, there is no stimulus for reaching so he does not have a motivation for propelling himself forward. Thus, prior art devices have been used to assist blind children in their motor development and to provide a substitute for the visual stimulus of reaching.

Devices for assisting mentally or physically handicapped children in performing creeping exercises have been disclosed, for example, in U.S. Pat. Nos. 2,843,391, 3,532,356, and 3,992,023. These devices generally include a wheeled frame from which a body support is suspended. The child is placed on the suspended body support arranged so that his hands and feet may contact the ground in order to enable him to propel the wheeled frame by movement of his arms and legs. These devices suffer from several drawbacks which include restriction of the child's head or limbs, restriction on the degree of freedom of movement, and instability. These drawbacks make these prior art devices needlessly unsafe.

Another device has been proposed for overcoming the shortcomings of the aforementioned devices, and is described, for example, in U.S. Pat. No. 4,796,903. This device is similar to the aforementioned devices in that it includes a wheeled frame from which a body support is suspended, and is used by a child in the same manner as described above. The device proved to be more comfortable, safer, and less restrictive than the aforementioned devices, and is readily adjustable and capable of being disassembled for replacement and/or cleaning of parts. Unfortunately, it also suffers from several drawbacks. First, the wheeled frame itself is prone to collapse. The wheeled frame is constructed from many parts which are bolted together. The bolts can easily come loose as the device is used. This places the child at risk, in an environment and in an application which should be as risk-free as possible. Second, the structure of the wheeled frame is such that the parts can easily be bent, which decreases its usefulness and makes it unsafe. Third, the wheeled frame must be assembled from multiple parts, which requires excessive manufacturing time and makes it difficult to clean. Finally, the straps which tailor the device to children of different sizes are cumbersome to use and can only be adjusted in predetermined increments, rather than providing for true adjustability.

SUMMARY OF THE INVENTION

The present invention is a device which can be used to assist mentally or physically handicapped persons in the performance of creeping exercises and activities and which overcomes the limitations of the prior art device described hereinabove by providing a device for assisting in creeping exercises having a support sling which is self-locking and fully adjustable.

The present invention comprises a creeper base which serves as the structural frame for the assisting creeper device. The creeper base has opposing parallel side walls and a structural support rib extending therebetween. In order to provide mobility of the creeper base in all horizontal directions, casters which correspond to the caster receiving holes are operably coupled to the frame. Each side wall also has in a top side a bar which defines an inner slot and an outer slot. The slots extend fully through the top side such that each slot is accessible from the bottom side of the side wall.

The support sling is coupled around the bars. Specifically, in one embodiment of the invention, the support sling has the length more than substantially double the distance between the side walls, and the width substantially equal to or less than the length of the inner and outer slots. Additionally, the support sling has a first end and a second end coupleable to each other. In coupling the support sling around the bars, the first end is passed into and through the outer slot of one of the side walls, looped around the bar, and passed out from and through the accompanying inner slot. Similarly, the second end is passed into and through the corresponding outer slot of the other of the side walls, looped around the bar, and passed through and out from the accompanying inner slot. Thereafter, the first end is coupled to the second end, such that the support sling forms a sagging closed loop.

In operation, a person assumes a creeping position with his torso resting on the support sling. As the weight of the person's torso creates tension on the support sling, for each sling-bar coupling, the area of the support sling which enters the outer slot presses down on the area of the support sling which exits the inner slot, which in turn presses down on the top side of the side wall. The resulting friction serves to lock the support sling in place, which supports the weight of the person's torso. Although the first end and the second end of the support sling are coupled together, this coupling is not often needed to lock the support sling as described. In this position, the person is able to easily engage in creeping activity in all directions, with the bulk of his weight being supported by the support sling.

Hand rails are attached to the creeper base, one on each of the side walls. These hand rails can be gripped by the user, making it easy for the user to assume a creeping position on the support sling.

Several advantages over the prior art are immediately evident. First, the present invention does not serve to restrict the child's head or limbs. It simply supports the child's weight without requiring the child to be strapped in or otherwise confined to a specific position.

Second, the support sling of the present invention allows the present invention to be tailored to any child size, as opposed to the straps of the prior art devices which via a belt-hole and belt-buckle type of arrangement confine the adjustment to predetermined increments in child size. Further in this regard, the support sling of the present invention provides a much easier method of adjustment. The most effort one must exert is to uncouple the coupling between the first end and the second end of the support sling, nudge the support sling one direction or the other, and reattach the coupling. This is much easier than buckling and unbuckling two straps, and rebuckling them.

Third, the present invention does not restrict the horizontal direction of the creeping activity, but rather allows the child free range of movement.

Fourth, the present invention is extremely stable, as it is of single-piece frame, wide-base sturdy construction. There are no parts which can bend or which could cause it to collapse. This make it much safer overall, increases its usefulness, and lengthens it useful life.

Finally, the present invention can be formed as a single-piece plastic construction which is easy to manufacture through well-known molding procedures, and easy to clean with any number of common household cleaners and water.

Further features and advantages of the invention will appear more clearly on a reading of the detailed description of the preferred embodiment of the invention, which is given below by way of example only and with reference to the accompanying drawings.

DETAILED DESCRIPTION OF THE PREFERRED EMBODIMENT

Figure 1:
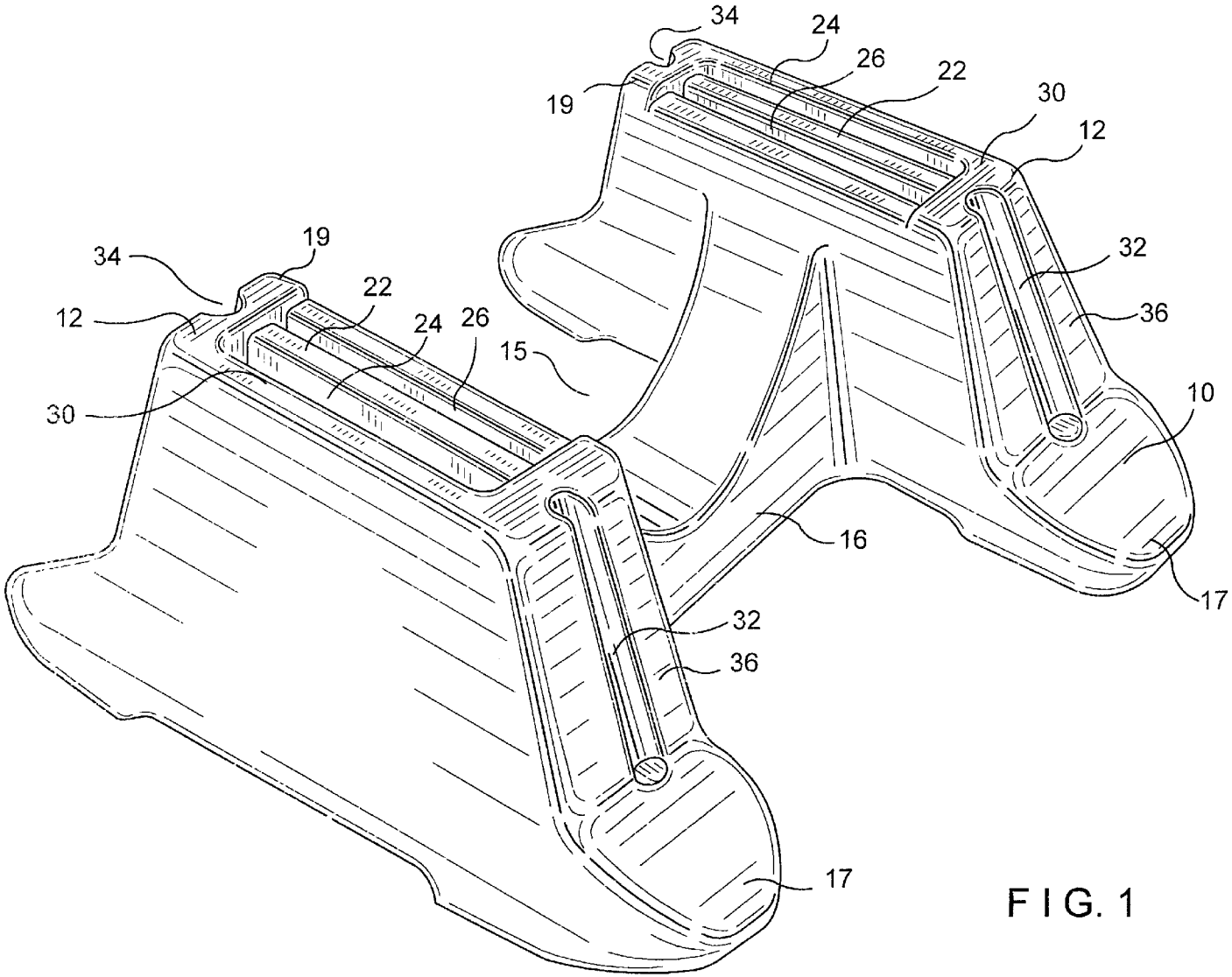
FIG. 1 is a perspective view of the creeper base of the preferred embodiment of the present invention.
Figure 2:
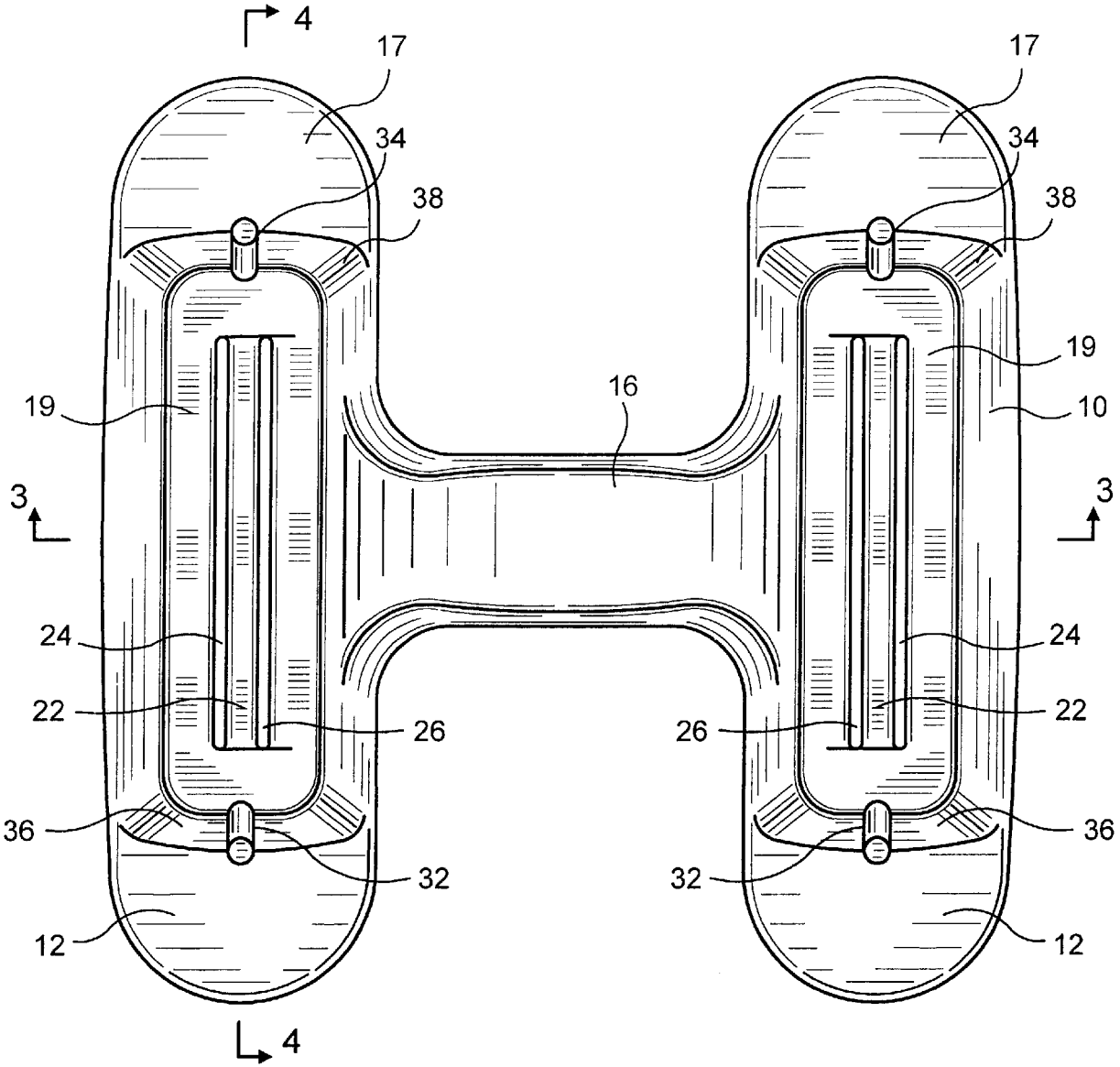
FIG. 2 is a top view of the preferred embodiment of the creeper base of the present invention.

Referring to FIGS. 1 through 6, among major elements of the present invention are: an exercise support frame, or creeper base 10 having opposing side supports, or side walls 12 and rigid connection means, or structural support rib 16 extending therebetween. A user receiving cavity 15 is formed between inner surfaces of the side walls 12 and an upper surface of the structural support rib 16.

Each side wall contains lower 17 and upper 19 portions, whereas the width of the lower portion being substantially greater than the corresponding dimensions of the upper portion. The vertical planes passing longitudinally through the central part of the side walls are substantially parallel to each other with the structural support rib 16 being transverse to such vertical planes.

The upper portion 19 of each side wall is positioned substantially parallel to the ground. An attachment arrangement or bar 22 is provided within each upper portion so as to define an outer slot 24 and the inner slot 26. As best illustrated in at least FIGS. 1, 2 and 5, in the preferred embodiment of the invention, the inner 26 and outer 24 slots extend fully through the top portion 19 of the corresponding side wall and are substantially parallel to each other. It should be understood, however, that any suitable configuration of the slots is within the scope of the invention. In the embodiment of the invention in which the frame is formed as a hollow member (see FIGS. 3–5) the inner 26 and outer 24 slots and bars 22 are accessible from the bottom portion 50 of the corresponding side wall.

Each of the side walls 12 further comprises an auxiliary support arrangement, or pair of substantially vertical hand rail seats 32,34 formed respectively within a front side 36 and a rear side 38 thereof. In the assembled condition of the invention, the hand rail seats are adapted to receive hand rails 62. Compared to the prior art devices, the support frame of this design provides substantially better stability for the user during the creeping exercises.

Referring now to FIGS. 8 through 12, the present invention further comprises a flexible support means, or support sling 54 coupled around the bars 22 and adapted to accommodate a body of a user (not shown). In one embodiment of the invention (see FIGS. 8–10 and 12), the support sling 54 is provided with a first end 56 and a second end 58 and has the length more than double the distance between the side walls 12, and the width substantially equal to or less than the length of the inner slots 24 and outer slots 26. In coupling the support sling 54 of this embodiment of the invention around the supporting bars 22, the first end 56 is initially passed into and through the outer slot 24 of one of the side walls 12, looped around the supporting bar 22, and passed out from and through the corresponding inner slot 26. Similarly, the second end of the sling 58 is passed into and through the outer slot 24 of the other of the side walls 12, looped around the corresponding bar 22, and passed through and out from the corresponding inner slot 26. Thereafter, the first end 56 is coupled to the second end 58, such that the support sling 54 forms a sagging closed loop. It should be noted that the structural support rib 16 of the creeper base 10 is adapted to avoid the support sling 54 as it sags between the side walls 12.

The first and second ends of the sling are coupleable via any conventional attachment means. For example, in the embodiment of FIGS. 9–10 and 12, the first and second ends of the sling are coupleable via hook-and-loop arrangement, e.g., the first end 56 has two loop patches 57, and the second end 58 has two corresponding hook patches 59 adapted for mutual engagement.

Figure 13:
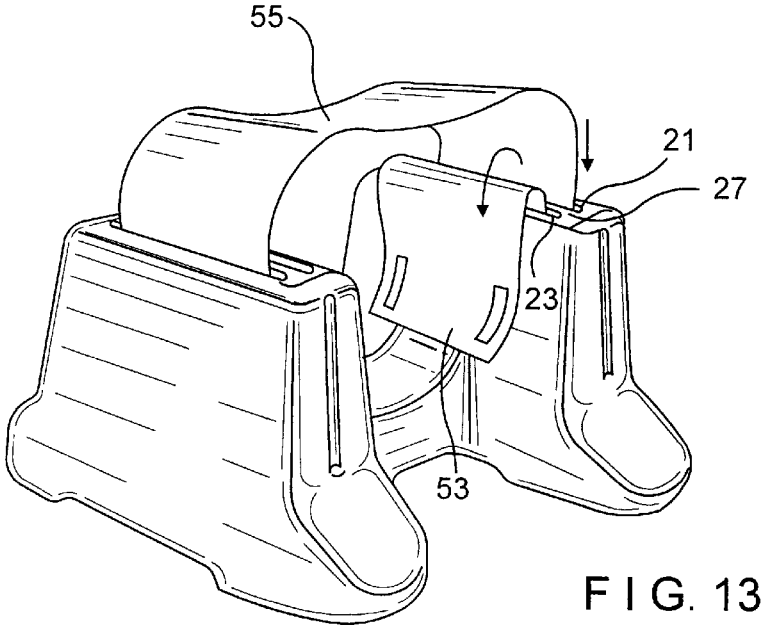
FIG. 13 is a perspective view of the embodiment of the invention with the sling having one free end.

FIG. 13 illustrates another embodiment of the invention in which the support sling 55 is provided with one free end 53 adapted for adjustably coupling around the bar 27 formed within the top portion of one side support. The other end of the sling can be fixedly connected to the bar or any other portion of the opposite side support. The free end 53 of the sling is coupled to the corresponding support bar 27 in a manner similar to that discussed hereinabove. In this respect, upon passing through the outer slot 21, the free end, from the interior of the corresponding side wall, is looped around the supporting bar 27 and passed out from and through the corresponding inner 23 slot. In this condition, the free end 53 can be attached, by any conventional means, to a portion of the sling facing the structural support rib 16.

Figure 14:
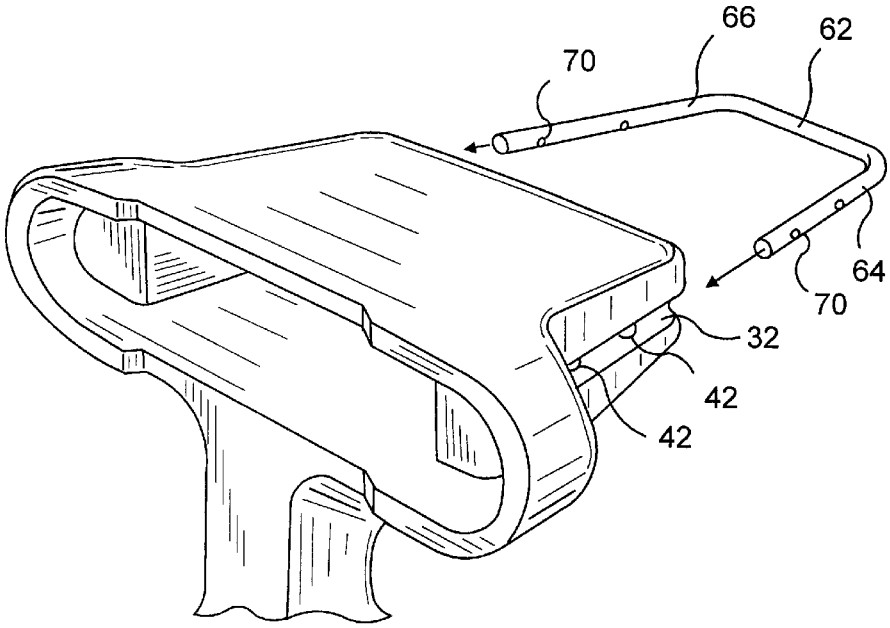
FIG. 14 is a perspective assembly partial view of the preferred embodiment of the present invention, showing one of the hand rails being coupled to the creeper base.
Figure 15:
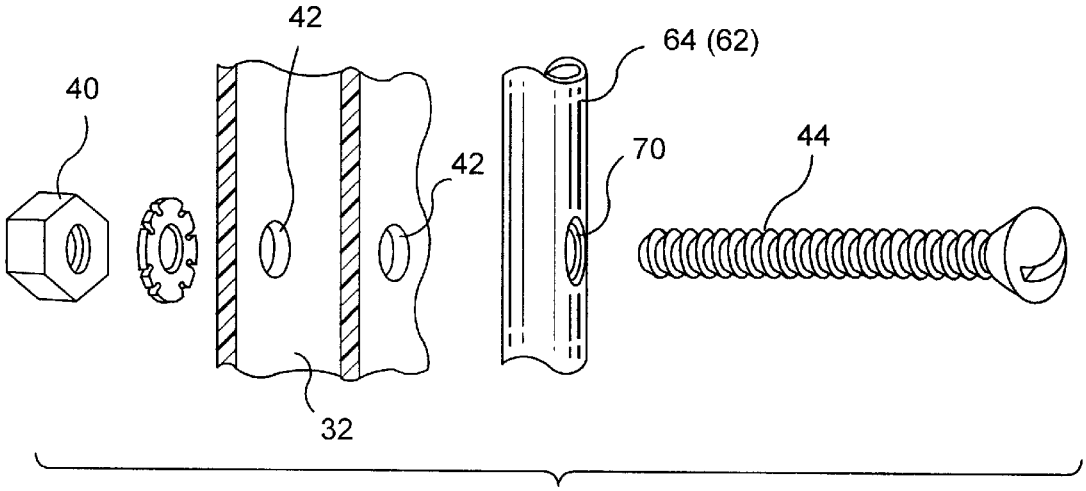
FIG. 15 is a magnified assembly partial view of the preferred embodiment of the present invention, showing one of the hand rails being coupled to the creeper base.
Figure 16:
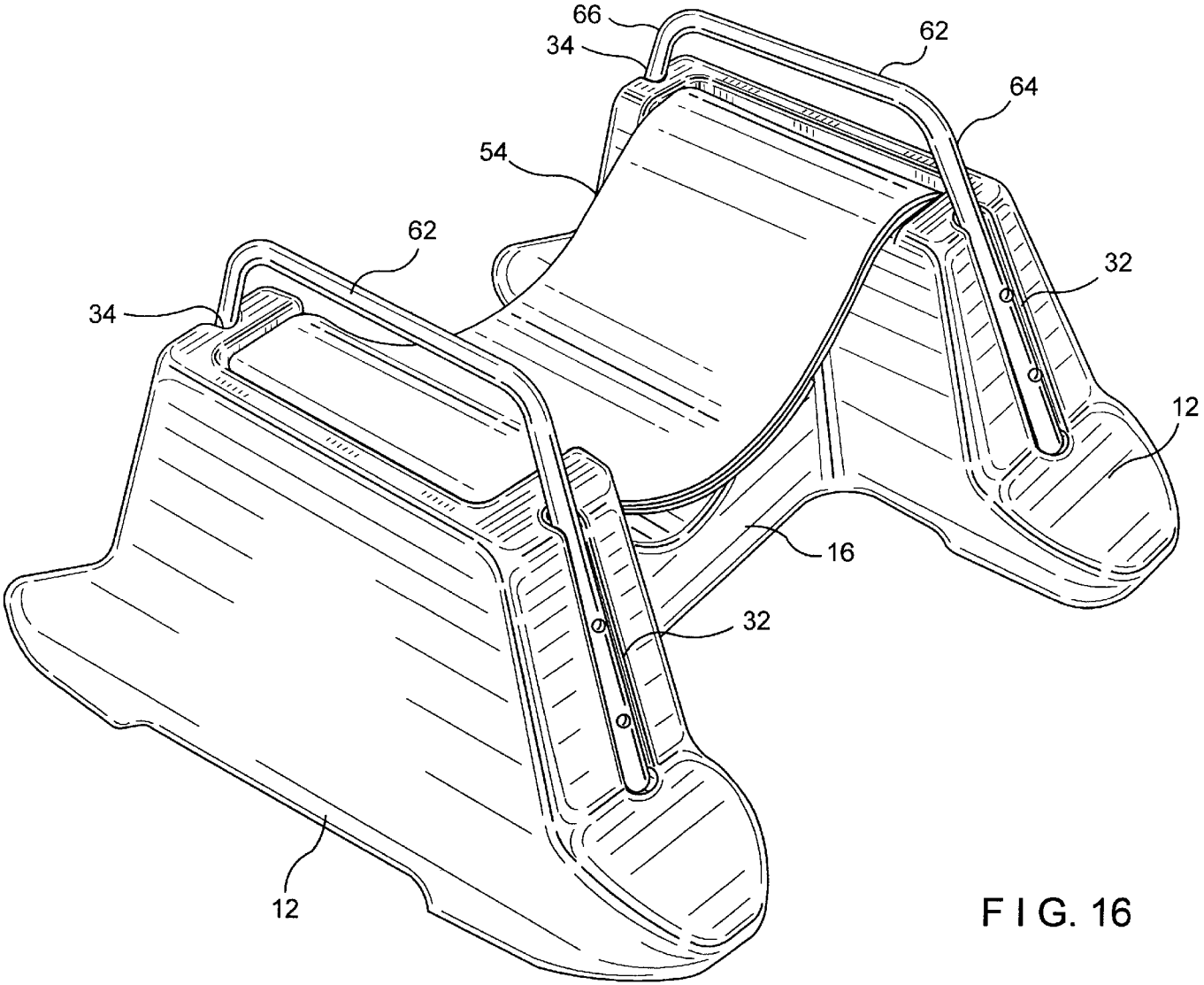
FIG. 16 is a perspective view of the preferred embodiment of the present invention in the fully assembled condition.

Referring now to FIGS. 14 through 16, the present invention further comprises an auxiliary support means, or pair of hand rails 62 each having dual arms 64,66. The hand rails are coupled to the hand rail seats 32,34. The arms can be fixedly attached to the corresponding rail seats in any conventional manner. For example, each of the arms 64,66, as shown in FIGS. 14–16, is formed having a set of arm bolt holes 70. Specifically, in coupling each of the hand rails 62 to its respective hand rail seats 32,34, one of the arms 64,66 is seated within one of the hand rail seats 32,34 and the other of the arms 64,66 is seated within the other of the hand rail seats 32,34. Thereafter, the set of bolts 44 is passed through the set of arm bolt holes 70 and through the set of bolt holes 42. The set of bolts 44 is secured through the coupling by the set of corresponding lock washer and nut assemblies 40.

Figure 5:
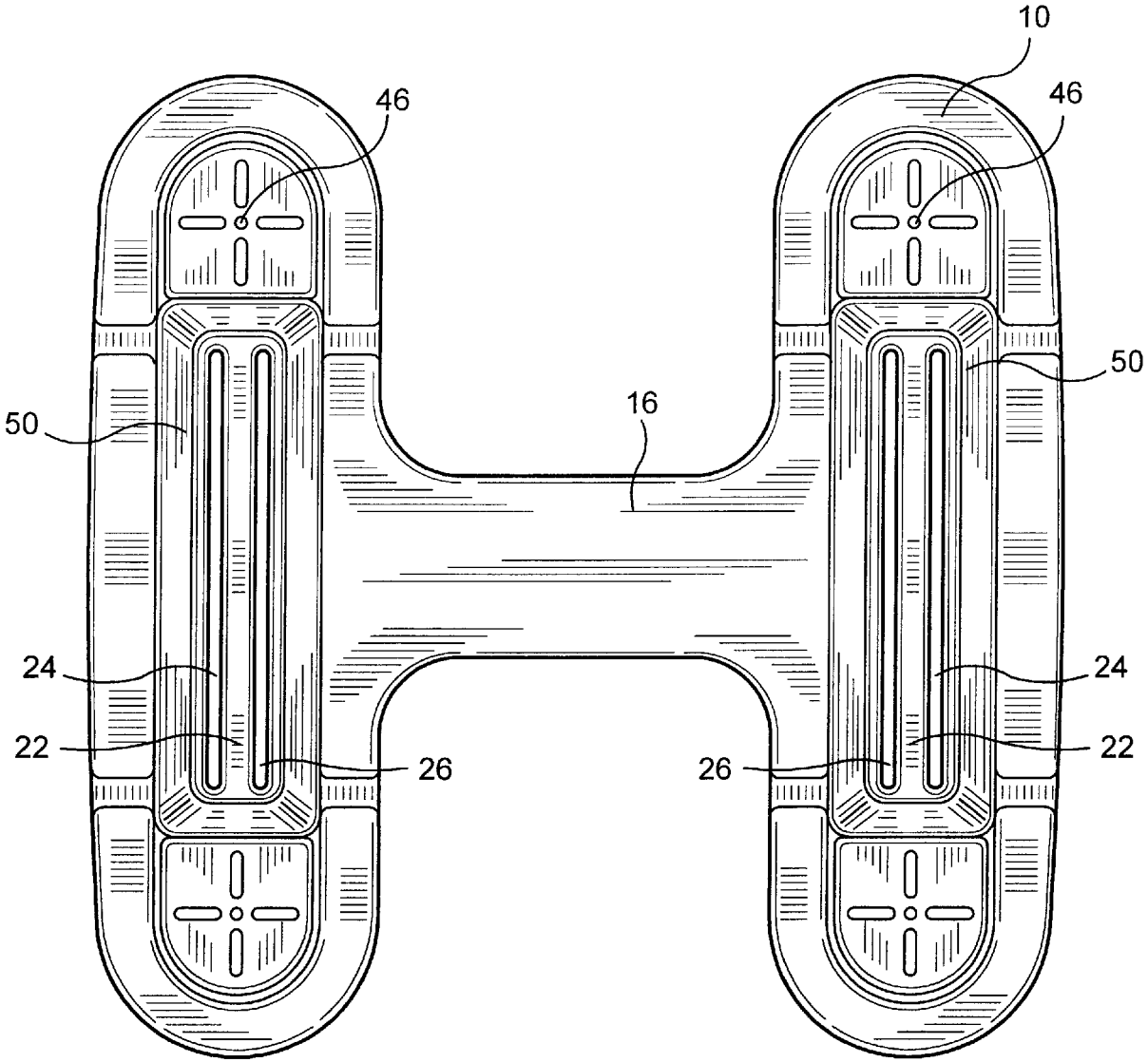
FIG. 5 is a bottom view of the preferred embodiment of the creeper base of the present invention.
Figure 6:
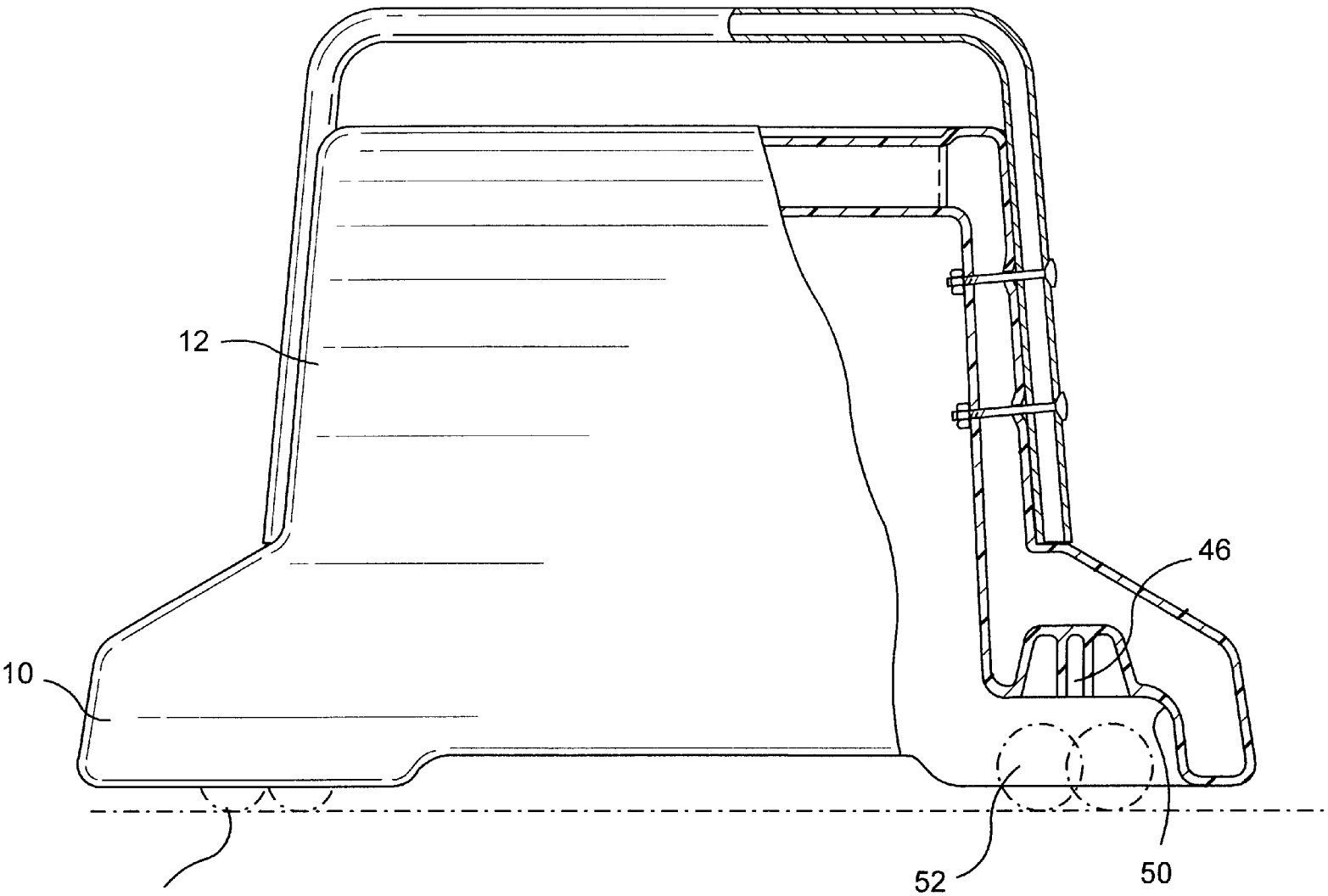
FIG. 6 is a cut away elevation assembly view of the preferred embodiment of the present invention, showing the creeper base and casters coupled thereto in outline.
Figure 7:
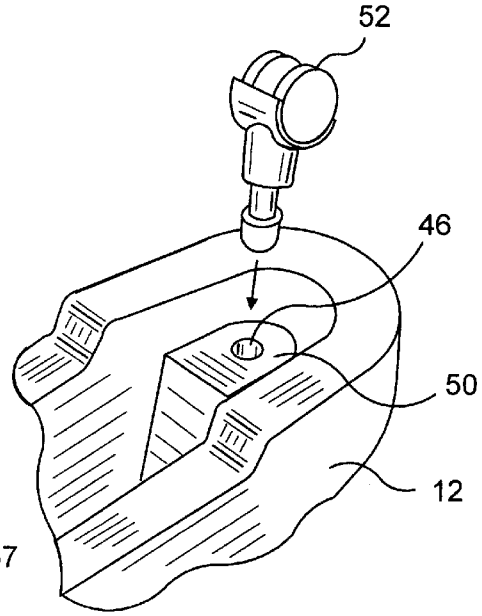
FIG. 7 is a perspective assembly partial view of the preferred embodiment of the present invention, showing one of the casters being coupled to the creeper base.

Referring now to at least FIGS. 5, 6 and 7, each of side walls 12 comprises an attachment arrangement for movement permitting means. In the preferred embodiment of the invention this attachment arrangement is formed as a set of caster receiving holes 46 provided at the bottom side 50 of the side wall 12. Movement permitting means, or plurality of casters 52 corresponding to and operably coupled within the caster receiving holes 46 are also provided.

Figure 3:
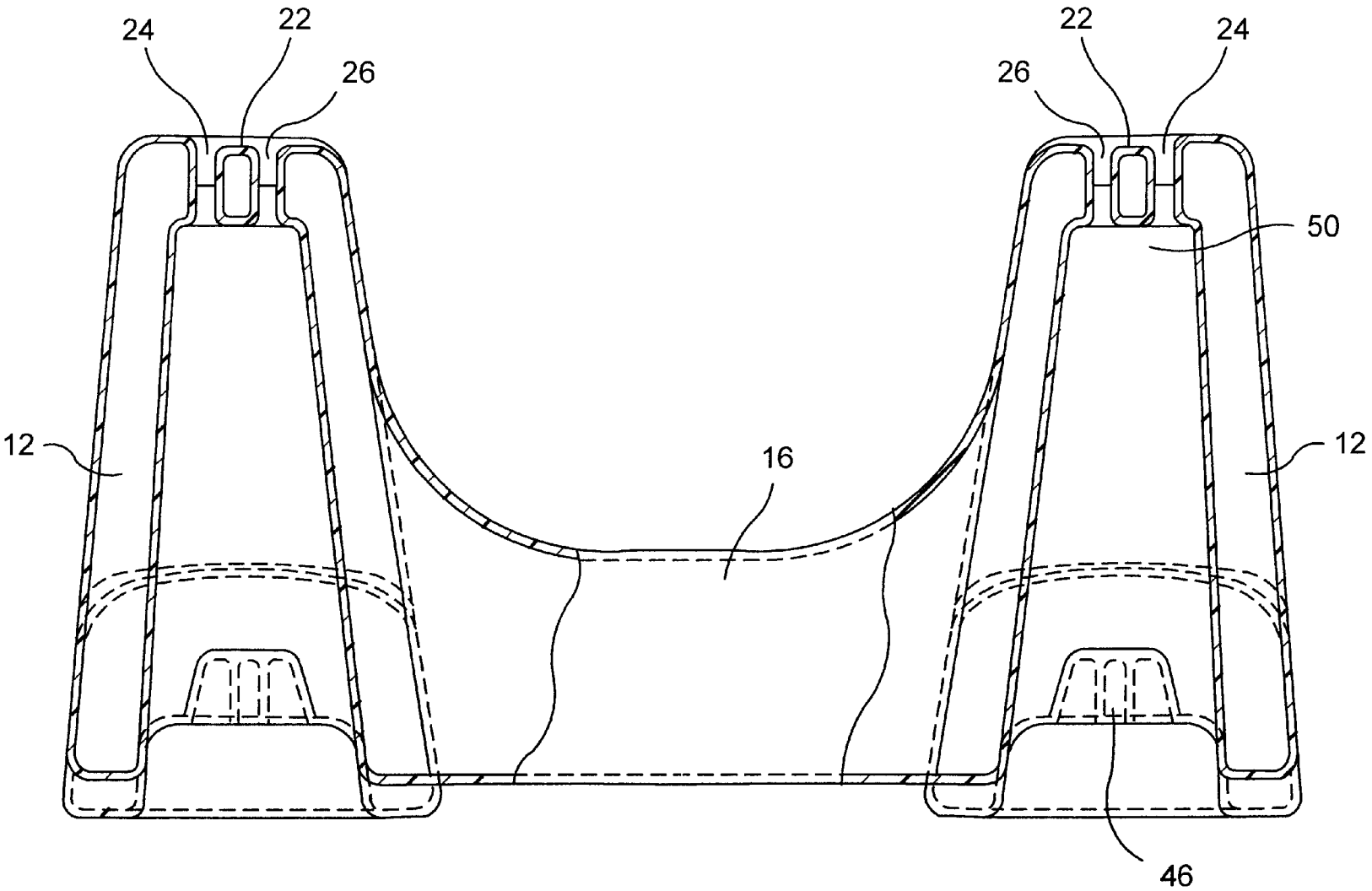
FIG. 3 is a sectional view of the creeper base of the preferred embodiment of the present invention, taken along the section line 3—3 of FIG. 2.
Figure 4:
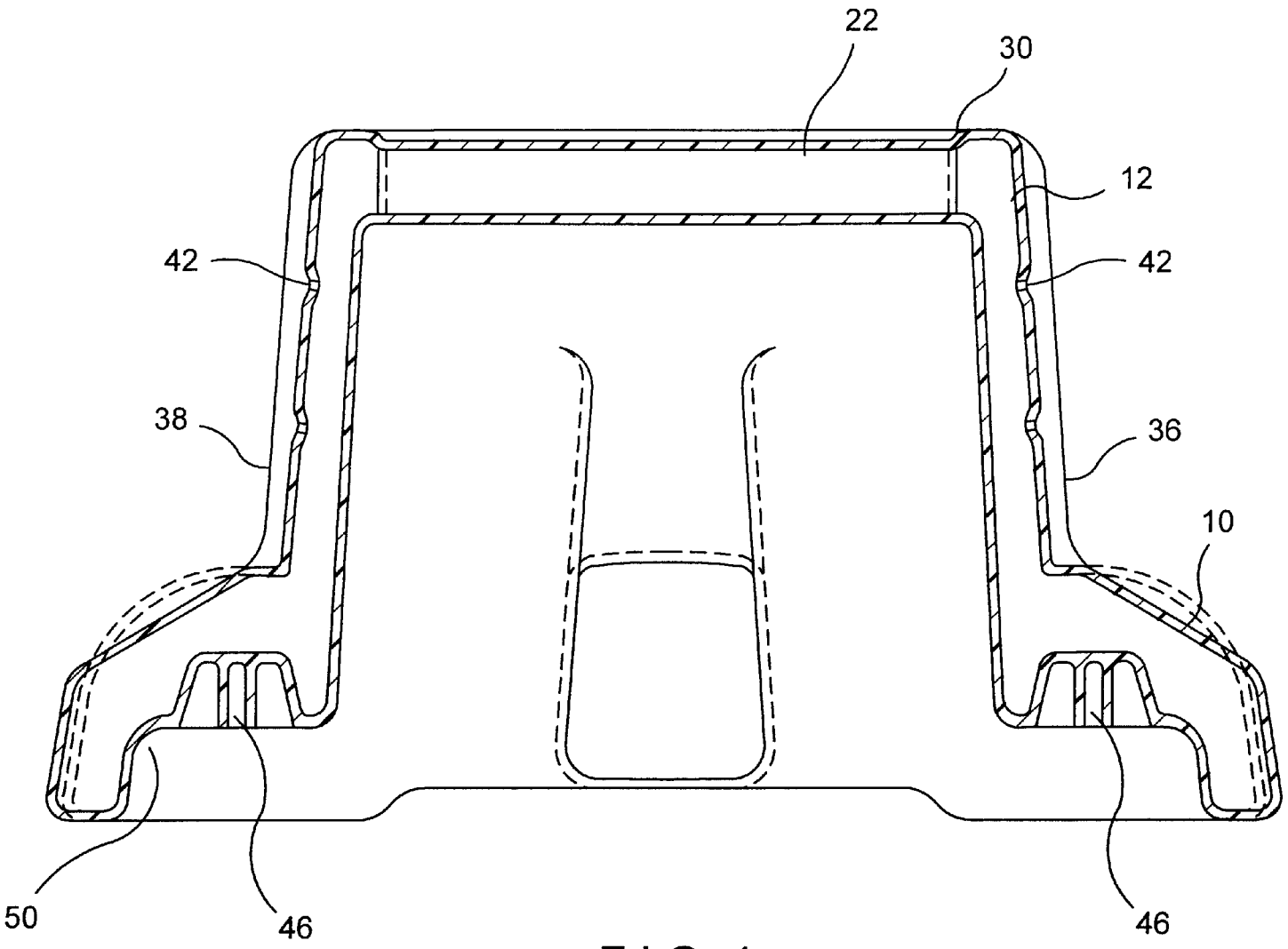
FIG. 4 is a sectional view of the creeper base of the preferred embodiment of the present invention, taken along the section line 4—4 of FIG. 2.

Although the support frame can be manufactured by any conventional means, in the preferred embodiment the base 10 is formed by common injection-molding procedures from plastic and is substantially hollow inside, as best shown in FIGS. 3 and 4.

Figure 8:
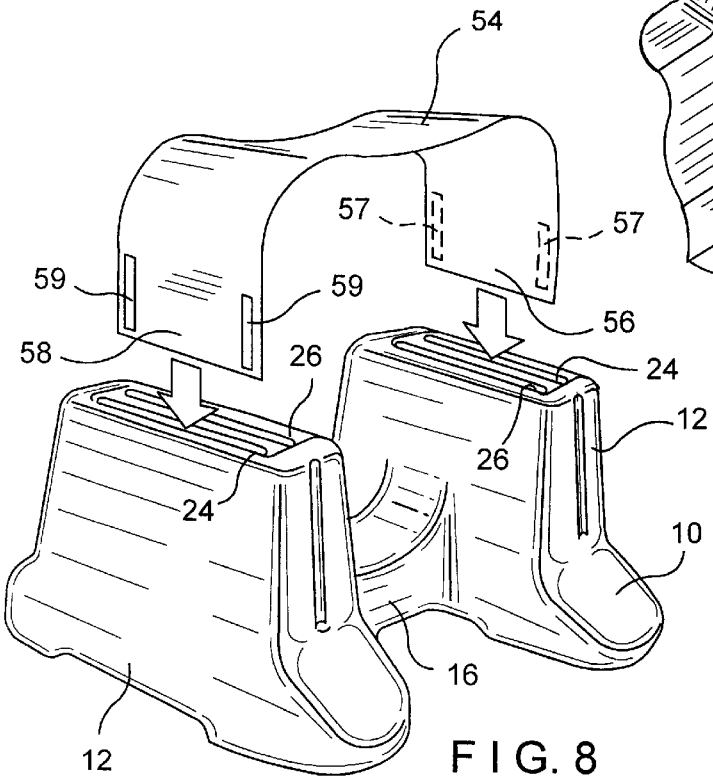
FIG. 8 is a first perspective assembly view of the preferred embodiment of the present invention, showing the support sling being coupled to the creeper base.
Figure 9:
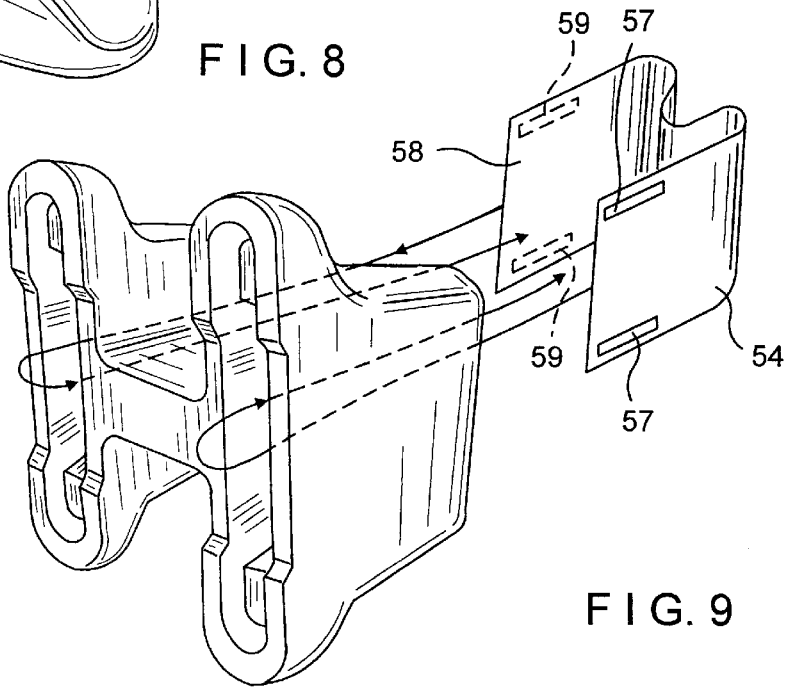
FIG. 9 is a second perspective assembly view of the preferred embodiment of the present invention, showing the support sling being coupled to the creeper base.
Figure 10:
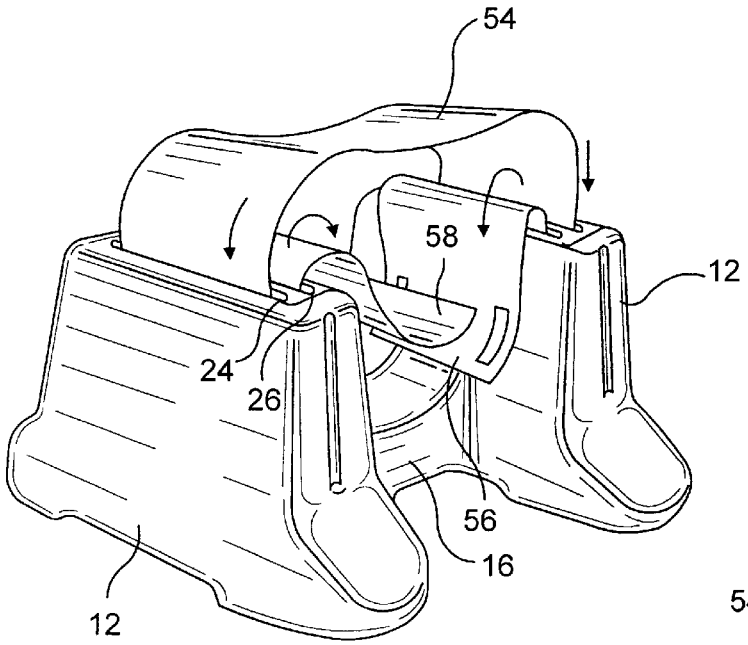
FIG. 10 is a third perspective assembly view of the preferred embodiment of the present invention, showing the support sling being coupled to the creeper base.
Figure 11:
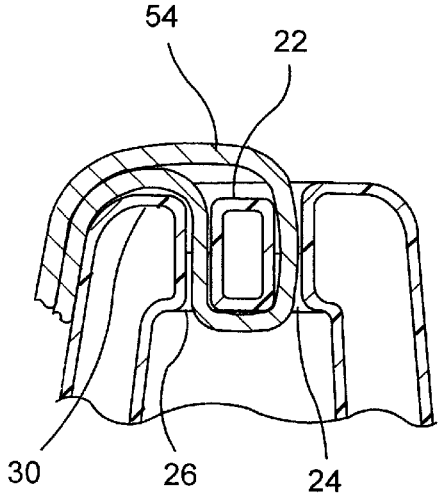
FIG. 11 is a partial sectional view showing locking of the sling during operation of the invention.

In order to prepare the device of the invention in a condition for use, the sling 54 is initially positioned in such a manner that a top surface thereof, adapted to engage a body of the user, faces the upward direction (see FIGS. 8 and 9). Then, both ends 56,58 of the sling are inserted into the interior of the support frame 12 through the outer slots 24 of the corresponding side walls. Access to the ends of the sling situated within the interior of the frame can be gained from a hollow bottom portion thereof. The ends of the slings are then fed through two inner slots 26 from the interior of the frame back to the exterior part thereof.

In order to provide height adjustment for the sling and corresponding positioning of the user's body within the device, the sling can be manually pulled at the slots. Both adjusted ends are then connected to form the bottom layer through engagement of the attachment arrangement associated with both ends of the sling (see FIG. 10). A correctly installed sling includes a continuous top layer adapted for engagement with the body of the user and a bottom layer formed by the ends of the sling in the attached overlap condition.

In detail, in order to provide adjustment of the positioning of the sling with respect to the frame, the first end 56 is uncoupled from the second end 58 of the support sling 54, and it is pulled outwardly within the inner slots 26 and the outer slots 24. This enables the invention to adjust the sag of the support sling 54 so as to most properly accommodate the body size of a user. In this condition, the sagging loop is adjusted by selectively matching securing elements 57 and 59 at the bottom layer of the sling (see FIG. 8).

In operation, a user grips the hand rails 62 for support as he assumes a creeping position with his torso resting on the top layer of support sling 54 (not shown). As the weight of the person's torso creates tension on the support sling 54, at each sling-bar coupling (see FIG. 11), the area of the support sling 54 situated in the vicinity of the outer slot 24 presses down on the area of the support sling 54 in the vicinity of the inner slot 26. This arrangement in turn presses down on the top side 30 of the side wall 12. The resulting friction serves to lock the support sling 54 in place, which supports the weight of the user's torso.

In use of the device for assisting in creeping exercises of the present invention, it is recommended that the first end 56 and the second end 58 of the support sling are coupled together. However, such coupling is typically provided for the convenience of the user and is not often needed for locking the adjusted position of the support sling 54 as described hereinabove. This is because the above discussed frictional forces are sufficient to lock the sling in the predetermined condition within the frame and to support the body of the user. In operation of the device of the invention, the person is able to easily engage in creeping activity in all directions, with the bulk of his weight being supported by the support sling 54 and suspended above the structural support rib 16. Thus, the user can move forward, backward or in any horizontal direction with the stomach spaced from the floor. In this condition, the user advances by reaching with one arm and pushing with the opposite leg and then repeating this pattern with the other arm and leg.

When the present invention is not in use, the creeper base 10 can be easily transported by gripping the hand rails 62 and lifting upwards or dragging horizontally. The hollow structure of the creeper base 10 makes the present invention lightweight and thus easy to use and transport.

Figure 12:
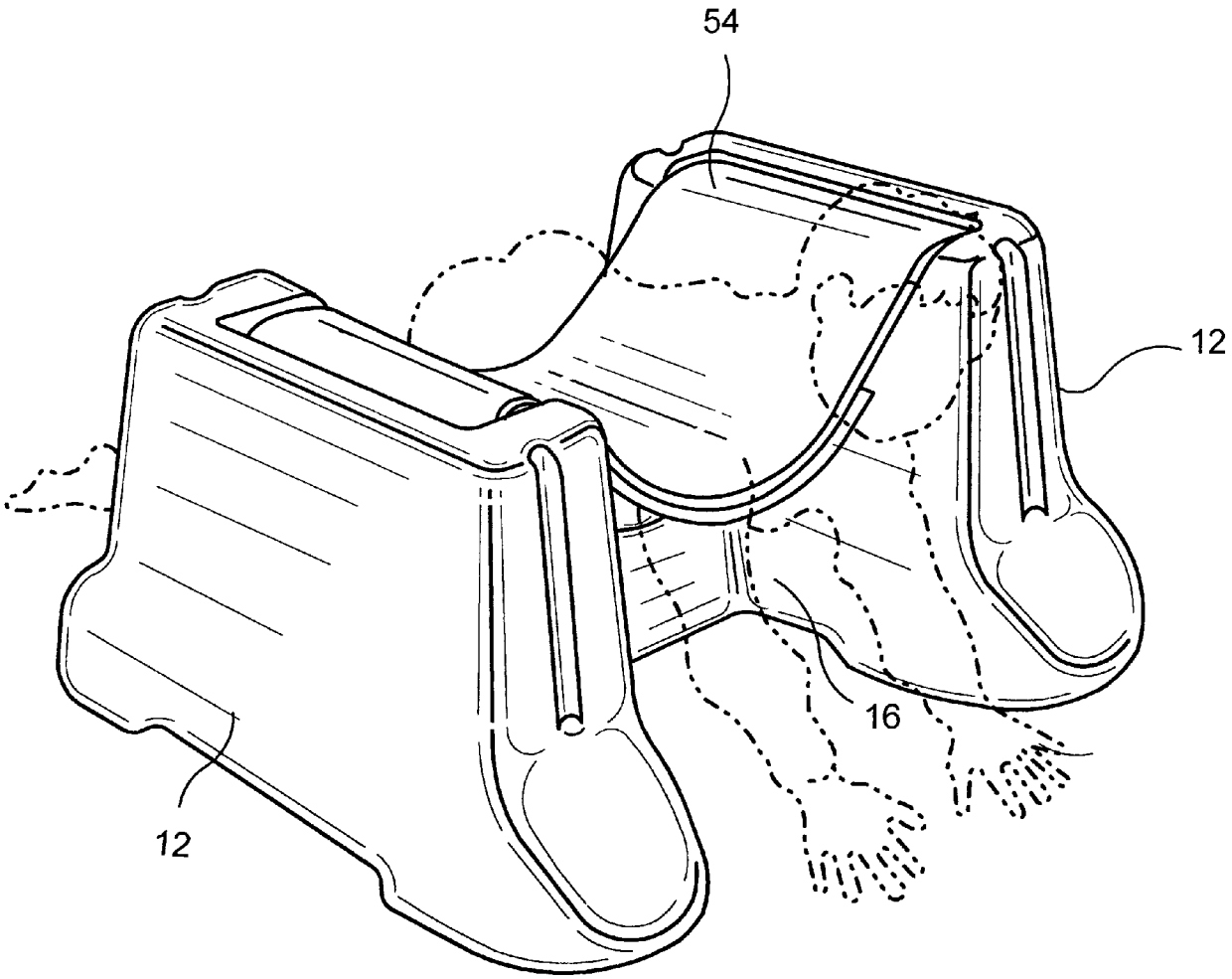
FIG. 12 is a perspective view of the preferred embodiment of the present invention, showing the support sling coupled to the creeper base.

The device of the present invention as illustrated in at least FIGS. 12 and 16 can be also used as an ambulation aid. The sling 54 can be used as adjustable seat making it possible for a user while sitting thereupon to propel himself with feet. In operating the invention in this fashion, reciprocal movement, heel-strike and coordinated knee flexion and extension is utilized. These patterns, which are necessary for ambulation can be utilized in the situations in which the sitting skills are developed before developing of the standing balance. In utilizing this mode of invention, the user is comfortably seated on the sling 54 while further supporting himself by holding the rails 62.

While preferred embodiments of the present invention have been shown and described, it shall be understood that persons having sufficient skill in the art may modify these embodiments without departing from the broad scope of the present invention.

What is claimed is:

1. A device for assisting in the performance of creeping exercise comprising:

an exercise support frame having first and second side supports and a structural support rib having at least a top side, so that a user receiving cavity is formed between said side supports and the top side of the structural support rib, each said side support having upper and lower portions, wherein an area of the lower portion of each said side support being substantially greater than an area of corresponding upper portion;

flexible support means for supporting of at least a torso of a user within said support frame during the exercise;

coupling means for adjustably coupling of said flexible support means to said upper portions of said support frame;

at least said first and second side portions are substantially hollow forming an inner space of the frame, so that said flexible support means and said coupling means can be accessed from the inner space of the frame, whereby when the torso of the user is placed on said flexible support means, one portion of said flexible support means engaging one of said side supports presses against another portion of said flexible support means and pressing against said frame, so that said flexible support means is locked in a predetermined position supporting the user.

2. A device of claim 1, wherein said flexible support means is a support sling having at least one end and said coupling means includes at least one bar coupled to the upper portion of one said side supports, said at least one end of said sling is looped around said at least one bar, said upper portion of each side support is positioned substantially parallel to the ground and each said side support is formed having a substantially trapezoidal cross section in the direction transverse to a longitudinal axis of the support rib.

3. A device of claim 2, wherein said at least one bar defines within said support frame a first inner slot and a first outer slot, so that said at least one end of said sling is looped around said first bar by passing through said first outer slot and through said first inner slot, whereby when said user is placed on said sling, a portion of said sling entering said first outer slot presses down against a portion of said sling exiting said first inner slot causing said portion of said sling exiting said first inner slot to press down against said frame, so that said portion of said sling entering said first outer slot and said portion of the sling exiting said first inner slot are locked in a predetermined position.

4. A device of claim 3, wherein said coupling means further comprising a second bar coupled to said second support and said support sling further comprises a second end thereof adapted to be looped around said second bar;

said second bar defining within said second support a second inner slot and a second outer slot, so that said second end of said sling is looped around said second bar by passing through said second outer slot and thereafter passing through said second inner slot, whereby when said torso of the user is placed on said sling, a portion of said sling entering said second outer slot presses down against a portion of said sling exiting said second inner slot causing said portion of said sling exiting said second inner slot to press down against said frame, so that said portion of said sling entering said second outer slot and said portion of said sling exiting said second inner slot to be locked in a predetermined position thereby supporting the weight of the user.

5. A device of claim 3, wherein an interior of said entire frame is hollow and said first and second ends of the sling are coupled together by sling coupling means.

6. A device of claim 5, wherein said sling coupling means is a hook-and-loop assembly.

7. A device as claimed in claim 1, wherein said frame is of single-piece construction.

8. A device as claimed in claim 7, wherein said frame comprises a plastic material.

9. A device as claimed in claim 1, further including means for permitting movement of said frame.

10. A device as claimed in claim 9, wherein said means for permitting movement of said frame further includes a plurality of casters and means for coupling said plurality of casters to said frame.

11. A device as claimed in claim 10, wherein said frame includes a bottom side, and said means for coupling said plurality of casters to said frame includes a plurality of caster receiving holes on said bottom side corresponding to said plurality of casters and into which said plurality of casters can be operably coupled.

12. A device as claimed in claim 6, further comprising an auxiliary support means.

13. A device as claimed in claim 12, wherein said auxiliary support means includes at least one hand rail coupled to said frame via at least one hand rail coupling means.

14. A device as claimed in claim 13, wherein said at least one handrail consists of two handrails coupled to the frame via two hand rail coupling means, each said hand rail includes front and back arms each having at least one bolt hole, and wherein each said hand rail coupling means includes front and back hand rail seats disposed on said frame, corresponding to said front and back arms of said hand rail, each of said front and back hand rail seats having at least one bolt hole aligned respectively to said at least one bolt hole of said front and back arms, and wherein each of said hand rail coupling means further includes front and back coupling bolts, each having a coupling end and passing respectively through said at least one bolt hole of each of said front and back arms and passing respectively through said at least one bolt hole of each of said front and back hand rail seats, and wherein each of said hand rail coupling means further includes front and back nut assemblies fitted respectively on and tightened respectively to said coupling end of said front and back coupling bolts.

15. A device of claim 13, wherein each said side support further comprises substantially flat front and back regions positioned at an angle to each other and a substantially flat side region interconnecting said front and rear regions;

said at least one hand rail includes front and back arms;

said at least one hand rail coupling means includes front and back hand-rail seats disposed within said frame; and wherein said front and back handrail seats are grooves extending inwardly from and longitudinally along the respective front and back regions, so that openings are formed at an intersection of the top side of said at least one side support and said grooves to facilitate mounting of the respective handrail.

16. A device of claim 2, wherein said coupling means further includes a second bar coupled to the upper portion of the second side support, said sling is looped around said first and second bars, so that said first and second bars and said sling can be accessed from the inner space of the frame.

* * * * *